US009468261B2

(12) United States Patent
Smaldone et al.

(10) Patent No.: US 9,468,261 B2
(45) Date of Patent: Oct. 18, 2016

(54) ARTICLE WITH ADJUSTABLE STIFFNESS TONGUE

(71) Applicant: Nike, Inc., Beaverton, OR (US)

(72) Inventors: Patricia L. Smaldone, Portland, OR (US); Stephen D. Pelletier, Jr., Portland, OR (US); Jeremy L. Connell, Hillsboro, OR (US); Steven C. McDonald, Heber, UT (US)

(73) Assignee: Nike, Inc., Beaverton, OR (US)

( * ) Notice: Subject to any disclaimer, the term of this patent is extended or adjusted under 35 U.S.C. 154(b) by 322 days.

(21) Appl. No.: 13/939,213

(22) Filed: Jul. 11, 2013

(65) Prior Publication Data

US 2014/0157625 A1 Jun. 12, 2014

Related U.S. Application Data

(60) Provisional application No. 61/734,773, filed on Dec. 7, 2012.

(51) Int. Cl.

| | |
|---|---|
| ***A43B 5/04*** | (2006.01) |
| ***A43C 11/00*** | (2006.01) |
| ***A43B 23/26*** | (2006.01) |
| ***A43B 1/00*** | (2006.01) |

(52) U.S. Cl.

CPC ..... *A43B 23/26* (2013.01); *A43B 1/0018* (2013.01); *A43B 5/0401* (2013.01)

(58) Field of Classification Search

CPC .... A43B 23/26; A43B 23/02; A43B 1/0018; A43C 11/00; A43C 11/16; A43C 11/165; A43C 11/20

USPC ..... 36/54, 50.1, 50.5; 24/712.1

See application file for complete search history.

(56) References Cited

U.S. PATENT DOCUMENTS

| | | | | |
|---|---|---|---|---|
| 87,655 | A * | 3/1869 | Foster | A43B 23/26 24/714.8 |
| 923,860 | A * | 6/1909 | Kroell | A43B 23/26 24/712.1 |
| 3,738,025 | A | 6/1973 | Hanson et al. | |
| 3,968,578 | A | 7/1976 | Rathmell | |
| 4,043,059 | A | 8/1977 | Rathmell | |
| 4,583,306 | A | 4/1986 | Paris | |
| 4,843,740 | A * | 7/1989 | Walkhoff | A43B 5/0458 36/118.6 |
| 4,937,951 | A | 7/1990 | Loecker | |

(Continued)

FOREIGN PATENT DOCUMENTS

| | | |
|---|---|---|
| DE | 4129270 A1 | 3/1993 |
| DE | 20 2008 000 952 U1 | 3/2008 |
| EP | 2 042 050 A1 | 4/2009 |

OTHER PUBLICATIONS

International Search Report and Written Opinion mailed Apr. 10, 2014 in PCT/US2013/073260.

(Continued)

*Primary Examiner* — Jila M Mohandesi

(74) *Attorney, Agent, or Firm* — Plumsea Law Group, LLC

(57) ABSTRACT

An article of footwear for snowboarding includes a tongue with adjustable stiffness. The tongue includes a flexible intermediate portion and the flexibility of the intermediate portion can be controlled by a tension control system. As the tension control system applies increased tension to the tongue, the flexibility of the intermediate portion is decreased, which increases the overall stiffness of the tongue.

20 Claims, 15 Drawing Sheets

(56) References Cited

U.S. PATENT DOCUMENTS

| | | | | |
|---|---|---|---|---|
| 4,937,953 | A | 7/1990 | Walkhoff | |
| 5,181,331 | A * | 1/1993 | Berger | A43B 1/0072 24/712.1 |
| 5,265,353 | A | 11/1993 | Marega et al. | |
| 5,339,545 | A | 8/1994 | Paris | |
| 5,575,090 | A | 11/1996 | Condini | |
| 5,829,169 | A | 11/1998 | James | |
| 6,119,374 | A | 9/2000 | Bollard et al. | |
| 6,128,837 | A * | 10/2000 | Huang | A43B 23/07 36/54 |
| 6,360,454 | B1 | 3/2002 | Dachgruber et al. | |
| 6,381,877 | B2 | 5/2002 | Filice | |
| 6,796,058 | B2 | 9/2004 | Pochatko | |
| 6,935,054 | B2 | 8/2005 | Hall et al. | |
| 7,290,355 | B2 | 11/2007 | Labonte | |
| 7,540,100 | B2 | 6/2009 | Pawlus et al. | |
| 7,810,258 | B2 | 10/2010 | Narajowski et al. | |
| 7,992,326 | B2 | 8/2011 | Trinkaus et al. | |
| 8,234,798 | B2 | 8/2012 | DiBenedetto et al. | |
| 8,321,984 | B2 | 12/2012 | Dojan et al. | |
| 2001/0042324 | A1 * | 11/2001 | Filice | A43B 5/1691 36/115 |
| 2002/0092205 | A1 | 7/2002 | Hall et al. | |
| 2004/0074110 | A1 | 4/2004 | Borsoi | |
| 2004/0200098 | A1 | 10/2004 | Martin et al. | |
| 2004/0244221 | A1 | 12/2004 | Hall et al. | |
| 2004/0250452 | A1 | 12/2004 | Farys | |
| 2005/0066546 | A1 | 3/2005 | Elkington et al. | |
| 2005/0204585 | A1 * | 9/2005 | Loveridge | A43B 1/0018 36/54 |
| 2005/0205585 | A1 * | 9/2005 | Chiu Huang | B65D 15/18 220/643 |
| 2006/0037215 | A1 | 2/2006 | Lee | |
| 2006/0196083 | A1 * | 9/2006 | Martin | A43B 5/0401 36/50.5 |
| 2010/0139057 | A1 | 6/2010 | Soderberg et al. | |
| 2011/0088285 | A1 | 4/2011 | Dojan et al. | |
| 2011/0214313 | A1 | 9/2011 | James et al. | |
| 2012/0167418 | A1 | 7/2012 | Frappier | |
| 2014/0115928 | A1 | 5/2014 | Pelletier, Jr. | |

OTHER PUBLICATIONS

International Search Report and Written Opinion mailed Apr. 29, 2014 in PCT/US2013/073211.

International Preliminary Report on Patentability and Written Opinion of the International Searching Authority issued Jun. 9, 2015 in International Patent Application No. PCT/US2013/073211.

Restriction and Election of Species Requirement mailed Feb. 11, 2016 in U.S. Appl. No. 13/939,210.

Response to Restriction and Election of Species Requirement filed Feb. 25, 2016 in U.S. Appl. No. 13/939,210.

Office Action mailed Mar. 3, 2016 in U.S. Appl. No. 13/939,210.

Amendment filed Jun. 28, 2016 in U.S. Appl. No. 13/939,210.

Notice of Allowance mailed Jul. 27, 2016 in U.S. Appl. No. 13/939,210.

* cited by examiner

ARTICLE WITH ADJUSTABLE STIFFNESS TONGUE

RELATED APPLICATION

This application claims the benefit of U.S. Provisional Patent Application No. 61/734,773, filed Dec. 7, 2012, and titled "Article with Adjustable Stiffness Tongue," which is herein incorporated by reference in its entirety.

BACKGROUND

The present embodiments relate generally to footwear and in particular to articles of footwear with tongues.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter.

The sole structure is secured to a lower portion of the upper so as to be positioned between the foot and the ground. In athletic footwear, for example, the sole structure may include a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and may be fashioned from a durable and wear-resistant rubber material that includes texturing to impart traction. The sole structure may also include a sockliner positioned within the upper and proximal a lower surface of the foot to enhance footwear comfort.

Articles for use in activities such as skiing and snowboarding may be configured to engage bindings on skis and/or snowboards. Some such articles include a more rigid outer shell and a softer inner bootie or liner.

SUMMARY

In one aspect, an adjustable tongue system for an article of footwear includes a tongue with at least one flex groove, where the at least one flex groove can open to allow the tongue to flex. The adjustable tongue system also includes a tensioning system associated with the tongue, where the amount that the flex groove can be opened is controlled using the tensioning system.

In another aspect, an adjustable tongue system for an article of footwear includes a tongue having an inner side and an outer side. The adjustable tongue system also includes a tensioning cable applying tension between an upper portion of the tongue and a lower portion of the tongue. The adjustable tongue system also includes a tensioning device capable of adjusting the tension of the tensioning cable, where a portion of the tensioning cable is disposed proximal of the outer side and where adjusting the tensioning cable controls the flexibility of the tongue.

In another aspect, an adjustable tongue system for an article of footwear includes a tongue and a tensioning system for controlling the flexibility of the tongue. The tongue is associated with a default position wherein the tongue is un-flexed and the tongue is capable of flexing to any position approximately between the default position and a first maximally flexed position when the tensioning system applies a first tension to the tongue. The tongue is capable of flexing to any position approximately between the default position and a second maximally flexed position when the tensioning system applies a second tension to the tongue. The first maximally flexed position is substantially further from the default position than the second maximally flexed position and the first tension is substantially less than the second tension.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
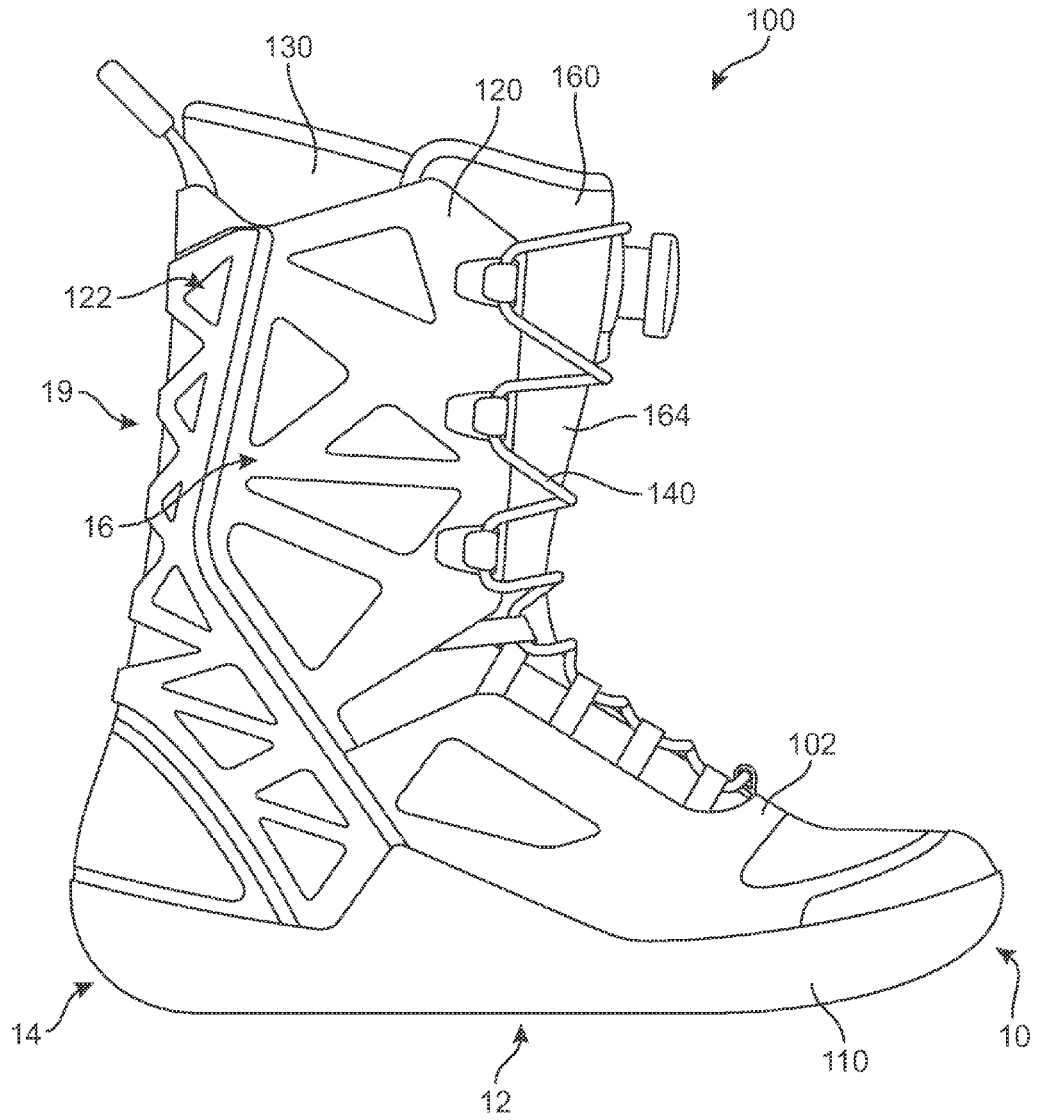
FIG. 1 is a side view of an embodiment of an article of footwear including an outer shell, an inner bootie and a tongue.

FIG. 1 illustrates a schematic isometric view of an embodiment of an article of footwear 100, also referred to simply as article 100. In one embodiment, article 100 may take the form of a boot used, for example, in snowboarding. In other embodiments, however, article 100 could take the form of any other kind of footwear including, but not limited to hiking boots, ski boots, various other kinds of boots as well as other kinds of footwear (e.g., soccer shoes, football shoes, sneakers, running shoes, cross-training shoes, rugby shoes, basketball shoes, baseball shoes as well as other kinds of footwear).

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18 (see FIG. 2). In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of a component, rather than precisely demarcating article 100 into two halves.

For consistency and convenience, directional adjectives are employed throughout this detailed description corresponding to the illustrated embodiments. The term "longitudinal" as used throughout this detailed description and in the claims refers to a direction extending a length of a component. In some cases, the longitudinal direction may extend from a forefoot portion to a heel portion of the article. Also, the term "lateral" as used throughout this detailed description and in the claims refers to a direction extending a width of a component, such as an article. For example, the lateral direction may extend between a medial side and a lateral side of an article. Furthermore, the term "vertical" as used throughout this detailed description and in the claims refers to a direction that is perpendicular to both the longitudinal and lateral directions. In situations where an article is placed on a ground surface, the upwards vertical direction may be oriented away from the ground surface, while the downwards vertical direction may be oriented towards the ground surface. Additionally, the term "proximal" and the term "distal" are used to refer to directions towards and away from, respectively, the interior cavity of article 100 that may receive a foot. It will be understood that each of these directional adjectives may be also be applied to individual components of article 100 as well.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper. One exemplary configuration for upper 102, shown in the figures, is described in further detail below.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

In some embodiments, article 100 may be configured with an outer shell 120 and an inner bootie 130. Outer shell 120 may comprise portions of upper 102 as well as sole structure 110, while inner bootie 130 may be disposed within outer shell 120. In some embodiments, inner bootie 130 may be a removable bootie or liner. In other embodiments, however, inner bootie 130 may be permanently attached and may not be removable. Various different booties, liners and other inserts for use with articles such as snowboarding boots and ski boots are known and any such provisions could be used with outer shell 120 in other embodiments.

Outer shell 120 may include a variety of provisions to facilitate support and/or comfort. For example, some embodiments of outer shell 120 may incorporate a lattice-like pattern along the lateral side 16, medial side 18 and rearward side 19. In some embodiments, portions of outer shell 120 may include openings 122 that are spaced in a manner to form a lattice-like configuration. In one embodiment, for example, openings 122 have an approximately triangular shape, though other embodiments may incorporate openings having any other shapes and/or sizes. This lattice-like configuration for portions of outer shell 120 may help reduce weight while maintaining strength for article 100.

Embodiments can include provisions for securing article 100 to a user's foot. In some embodiments, article 100 may utilize a fastening system such as a lacing system, strap system and/or combination of laces and straps for securing article 100 to a foot. In the embodiment shown in FIG. 1, article 100 includes lace 140 that is used to tension opening 150 (see FIG. 2) of outer shell 120.

Some embodiments can further include tongue 160 that is associated with outer shell 120 and generally disposed beneath lace 140. Tongue 160 may help secure a foot within article 100 and may also provide support and cushioning for the front part of a foot and lower leg (including the lower portion of the shin).

In snowboarding, the tongue may be used to transfer forces from the foot/lower leg to the bindings and ultimately the snowboard. For example, as a user leans forward so that the front of the foot and lower leg press against the tongue, the tongue may act as a lever to transfer forces from the foot/leg to the bindings and snowboard. Thus, in some embodiments, the tongue of a snowboard boot may be substantially stiffer than the tongue of some other types of footwear such as running shoes to facilitate increased leverage. Additionally, in some embodiments, a tongue in a snowboarding boot may provide protection from the bindings, as well as increasing durability of the overall article.

Although a tongue that is generally stiffer than the tongues of typical running shoes and sneakers may be desired for footwear such as snowboarding boots, different types of snowboarding activities may require different amounts of stiffness. For example, slopestyle snowboarding events typically require a user to navigate down a slope between different jumps, obstacles, etc. In order to facilitate increased maneuverability, a rider may want his or her boots to have some flexibility along the front side, especially in the area of the tongue. In contrast, for example, in half-pipe snowboarding events, a rider may prefer a great deal of stiffness in the front of the boots, which allows the tongue to act as a substantially rigid lever and more efficiently transfer force from the foot/leg to the bindings and snowboard.

Article 100 may include provisions that allow a user to adjust the stiffness of tongue 160 in order to facilitate usability of article 100 across a wide range of different activities, including a range of different snowboarding activities. In some embodiments, tongue 160 may be further associated with provisions that facilitate variable stiffness, including provisions that allow for controlled flexibility and/or bending.

Figure 2:
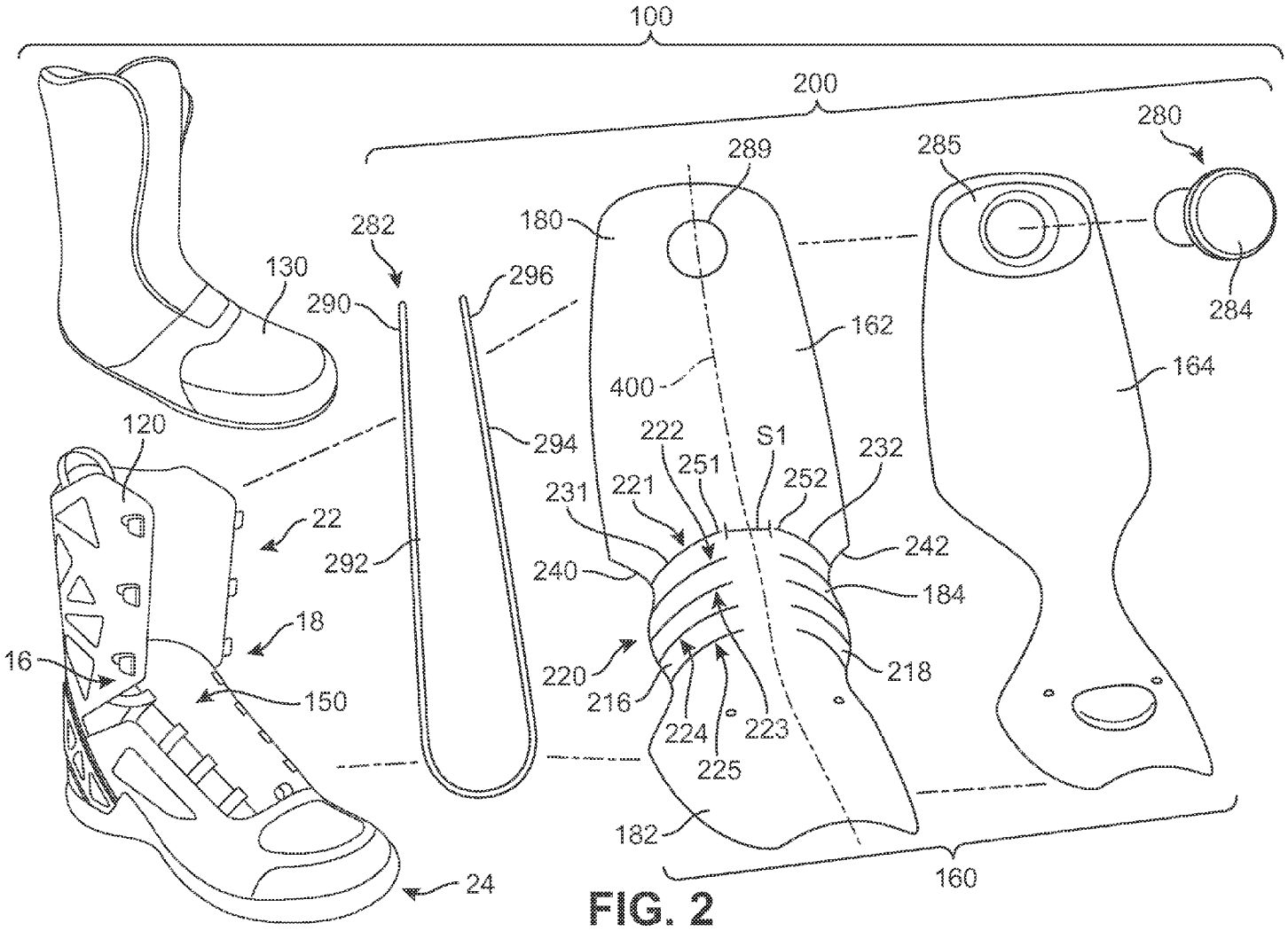
FIG. 2 is a schematic exploded isometric view of an embodiment of an article of footwear, in which various components of a tongue system are visible.
Figure 3:
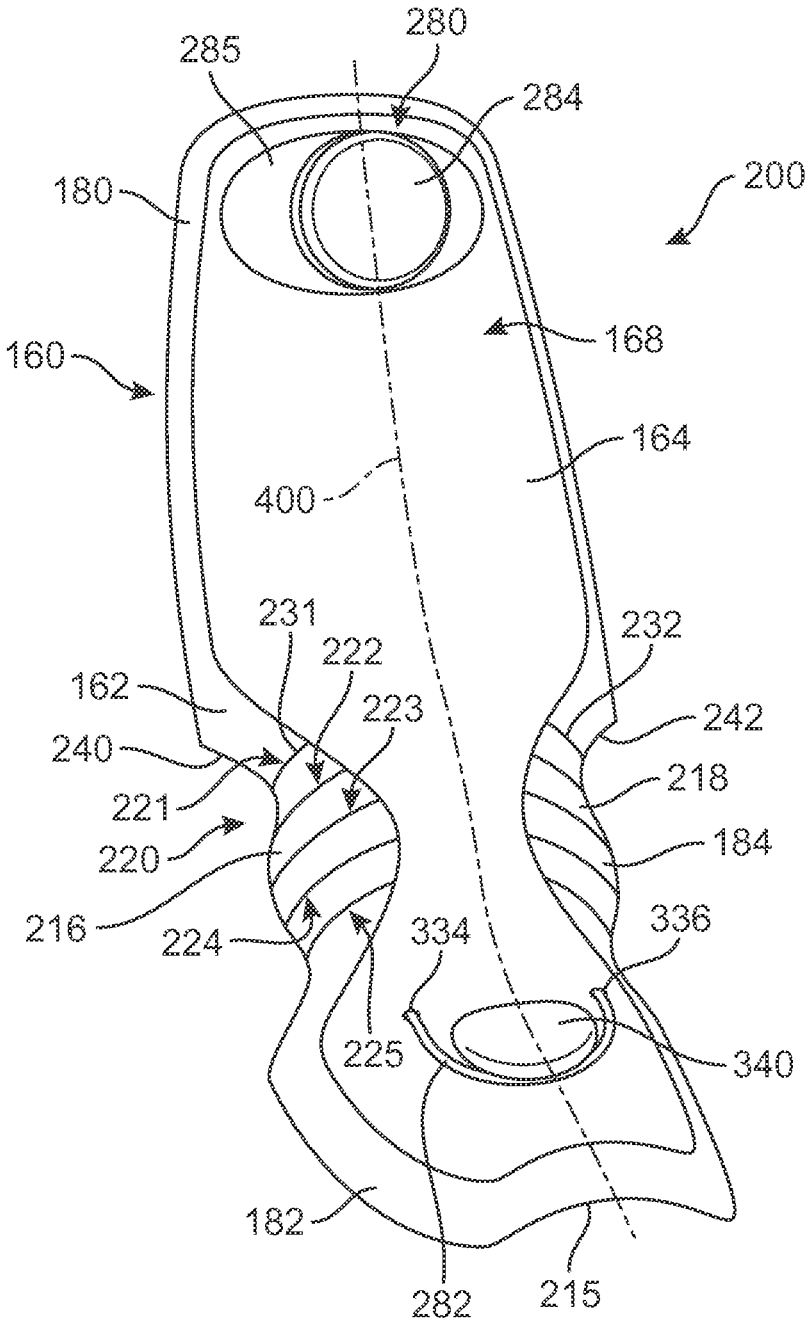
FIG. 3 is a schematic isometric view of an embodiment of a tongue system for an article of footwear shown in isolation from the article of footwear.
Figure 4:
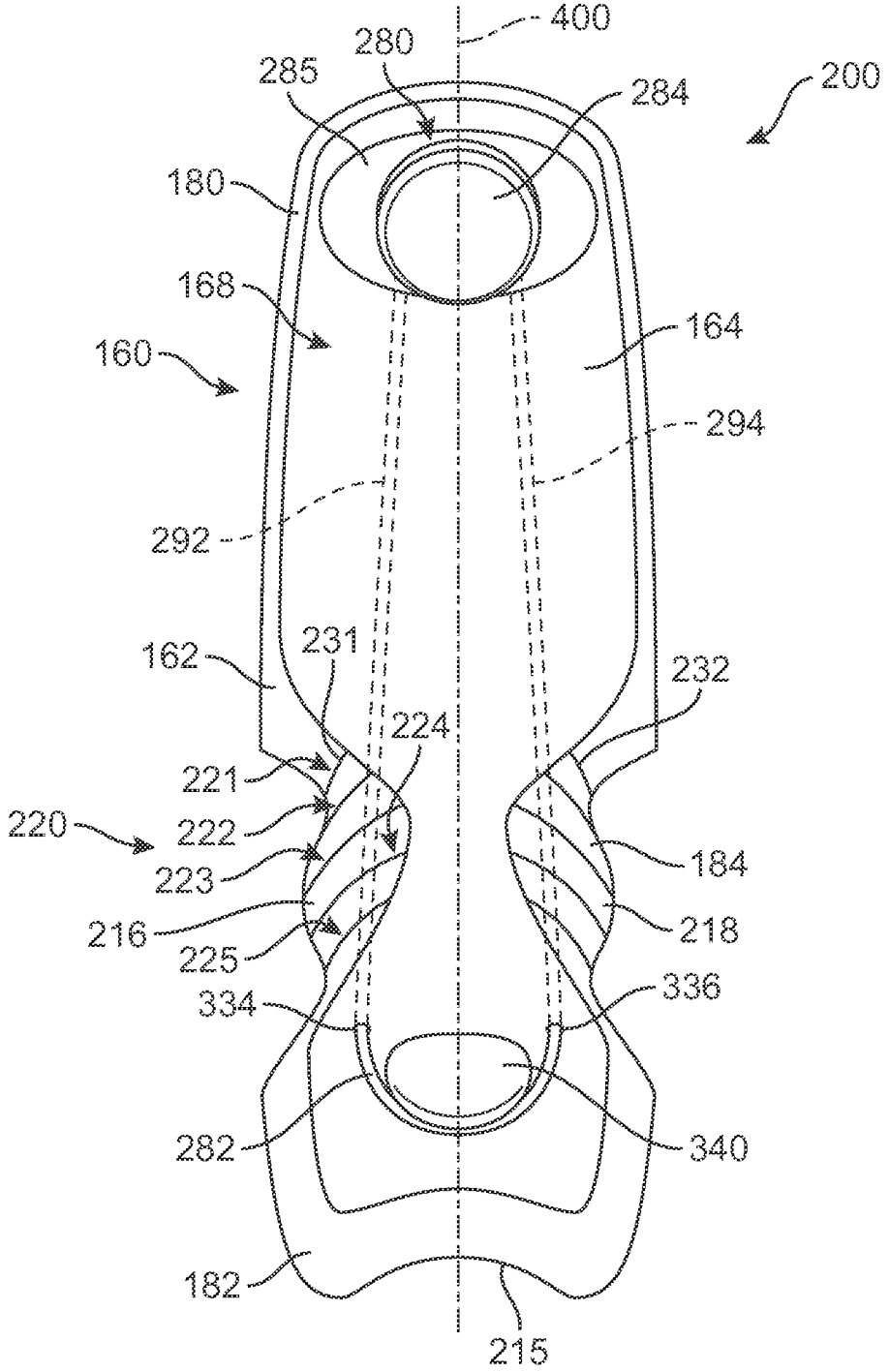
FIG. 4 is a schematic front view of the tongue system of FIG. 3.

FIGS. 2 through 4 illustrate various views of embodiments of tongue 160 as well as several components that together with tongue 160 comprise an adjustable tongue system 200, also referred to simply as tongue system 200. In particular, FIG. 2 illustrates an exploded isometric view of an embodiment of article 100, including outer shell 120 and inner bootie 130, while FIGS. 3 and 4 illustrate an isometric view and front view, respectively, of an embodiment of tongue system 200.

Referring to FIGS. 2 through 4, tongue system 200 may include tongue 160, which further comprises base member 162 and covering member 164. Base member 162 may be configured to confront bootie 130 along an inner side 166 (see FIG. 5) of tongue 160. In some embodiments, covering member 164 may be disposed on outer side 168 of tongue 160. In other words, in some embodiments, covering member 164 may be disposed distally to base member 162 and may generally be exposed along an outer surface of article 100 when worn by a user (as shown in FIG. 1).

In different embodiments, the material characteristics of base member 162 and covering member 164 can vary. In some embodiments, covering member 164 may be substantially more rigid than base member 162. In such an embodiment, base member 162 may more easily bend, flex and/or otherwise deform than covering member 164. Such a configuration allows base member 162 to provide cushioning and support on the inner side 166 of tongue 160 confronting the foot, while covering member 164 may provide strength and durability on the outer side 168 of tongue 160. In other embodiments, however, covering member 164 could be substantially less rigid than base member 162. In still other embodiments, base member 162 and covering member 164 could have substantially similar rigidities.

Generally, different components of tongue 160 may be made from various different materials. For example, in some embodiments, base member 162 may comprise one or more layers of a foam-like material, while covering member 164 may comprise a more rigid composite material, such as a carbon fiber composite material. In still other embodiments, base member 162 may comprise one or more layers of a foam-like material and covering member 164 may comprise a layer of plastic.

Figure 5:
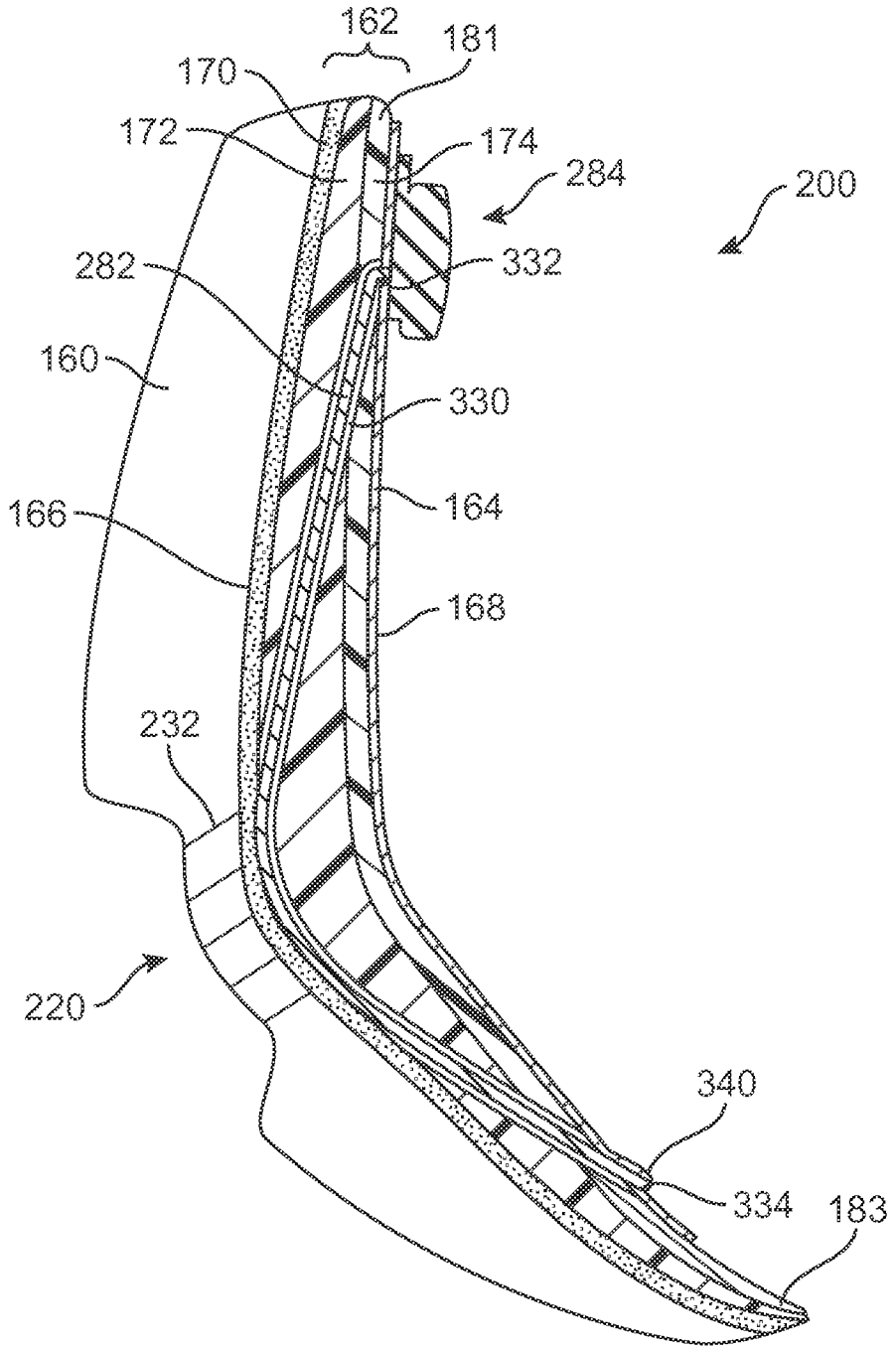
FIG. 5 is a schematic side cross-sectional view of the tongue system of FIG. 3.

In some embodiments, tongue 160 may comprise a plurality of layers, with each different layer imparting a desired structural characteristic to tongue 160. Referring now to FIG. 5, which shows a side cross-sectional view of an embodiment of tongue 160, base member 162 may further comprise a first layer 170, a second layer 172 and a third layer 174, where the second layer 172 is intermediate to the first layer 170 and the third layer 174. Each layer may be configured with specific structural properties. For example, in some embodiments, first layer 170, which may confront inner bootie 130 and/or the foot of a user directly, may be a substantially soft and compressible material. In addition, in some embodiments, second layer 172 may also be a substantially soft and compressible material. As seen in FIG. 5, in some embodiments, second layer 172 may have a greater thickness than first layer 170. In some embodiments, third layer 174 may be a compressible material that is generally more rigid than first layer 170 and/or second layer 172. This arrangement of layers may provide a structural gradient that is softer and more compressible along the inner side 166 of tongue 160 and gets progressively firmer and less compressible closer to the outer side 168 of tongue 160.

In an exemplary embodiment, base member 162 comprises three distinct foam-like layers. In particular, first layer 170 may be a soft foam and textile layer that is substantially similar to the inner lining of outer shell 120. Additionally, second layer 172 may be a soft ethylene-vinyl acetate (EVA) compression molded foam. Furthermore, third layer 174 may be made of a substantially firm foam, in particular, a foam material that is substantially more firm than the EVA foam comprising second layer 172.

In some embodiments, covering member 164 may be made of an elastomer material such as a polyether block amide (PEBA) elastomer. One particular example is the material PEBAX® manufactured by Arkema.

In different embodiments, the geometry of tongue 160 may vary. In some embodiments, tongue 160 may be contoured. In some embodiments, tongue 160 has a generally arcuate shape along a longitudinal direction of tongue 160. In particular, for example, the approximate shape of tongue 160 may be characterized as concave on outer side 168 and convex on inner side 166, which can be most clearly seen in FIG. 5. This arcuate geometry helps tongue 160 conform to the approximate shape of a user's foot, especially along the top of the foot. Furthermore, in some embodiments, tongue 160 may be contoured in a lateral direction. For example, the approximately arcuate shape of tongue 160 in the lateral direction is clearly indicated along lower peripheral edge 215 of tongue 160 (see FIGS. 3 and 4).

Referring again to FIGS. 2 through 4, base member 162 may be further characterized as having an upper portion 180, a lower portion 182 and an intermediate portion 184 disposed between the upper portion 180 and the lower portion 182. Upper portion 180 may generally be disposed closer to the ankle region 22 of article 100, while lower portion 182 may be disposed closer to toe portion 24 of article 100.

In some embodiments, intermediate portion 184 may be configured as a region of increased flexibility for tongue 160, especially for base portion 162. Different embodiments could utilize different provisions for accomplishing this increased flexibility, including the use of different materials for different portions. In some embodiments, structural features could be used to vary the flexibility of intermediate portion 184. In some embodiments, for example, intermediate portion 184 may include one or more flex grooves. Using flex grooves in intermediate portion 184 may impart a greater degree of flexibility to intermediate portion 184 as compared to the flexibility of upper portion 180 and lower portion 182.

In some embodiments, intermediate portion 184 may include plurality of flex grooves 220. In one exemplary embodiment, plurality of flex grooves 220 further comprises five sets of corresponding grooves on lateral side 216 and medial side 218 of base member 162. In particular, plurality of flex grooves 220 may include first set of flex grooves 221, second set of flex grooves 222, third set of flex grooves 223, fourth set of flex grooves 224 and fifth set of flex grooves 225. Each set of flex grooves may include two corresponding flex grooves on the lateral side 216 and the medial side 218 of base member 162. For example, first set of flex grooves 221 includes first flex groove 231 and second flex groove 232 on lateral side 216 and medial side 218, respectively.

Although the embodiment of FIGS. 2 through 4 illustrates a tongue 160 including five sets of corresponding flex grooves, in other embodiments, plurality of flex grooves 220 may include two, three, four, five, six or more sets of flex grooves. Still further, some embodiments could use a single set of flex grooves rather than multiple sets of flex grooves. In some embodiments, intermediate portion 184 could incorporate a single flex groove on the lateral side 216 or the medial side 218 of tongue 160. Furthermore, although the flex grooves of the embodiment shown in FIGS. 2 through 4 are generally symmetric about a central longitudinal axis 400 of tongue 160, other embodiments could incorporate any other arrangement of flex grooves including, for example, asymmetric arrangements.

In some embodiments, each flex groove may generally comprise a slit or cut formed in base member 162 that allows directly adjacent regions of base member 162 to separate from one another. In some embodiments, each flex groove may generally extend from a peripheral edge of intermediate portion 184 towards central longitudinal axis 400. In order to prevent total separation of adjacent sections of tongue 160, the corresponding sets of flex grooves may not meet at central longitudinal axis 400 and instead may be generally spaced apart from longitudinal axis 400. As an example, first flex groove 231 extends inwardly from lateral peripheral edge 240 of intermediate portion 184 towards central longitudinal axis 400. Likewise, second flex groove 232 extends inwardly from medial peripheral edge 242 of intermediate portion 184 towards central longitudinal axis 400. Moreover, the inward ends of first flex groove 231 and second flex groove 232 may be spaced apart from one another. For example, first inward end 251 and second inward end 252 may be spaced apart from one another by a spacing S1 (see FIG. 2). The remaining sets of flex grooves of plurality of flex grooves 220 may be arranged in a substantially similar configuration.

In some embodiments, the geometry of intermediate portion 184 may be selected to facilitate increased flexibility. For example, in some embodiments, intermediate portion 184 has a generally narrower width than upper portion 180 and lower portion 182. Furthermore, the contouring of lateral peripheral edge 240 and medial peripheral edge 242 may vary from the adjacent lateral and medial edges of upper portion 180 and lower portion 182. In some embodiments, the thickness of intermediate portion 184, especially on the lateral and medial sides, may vary substantially from the thickness of tongue 160 in upper portion 180 and lower portion 182.

Figure 6:
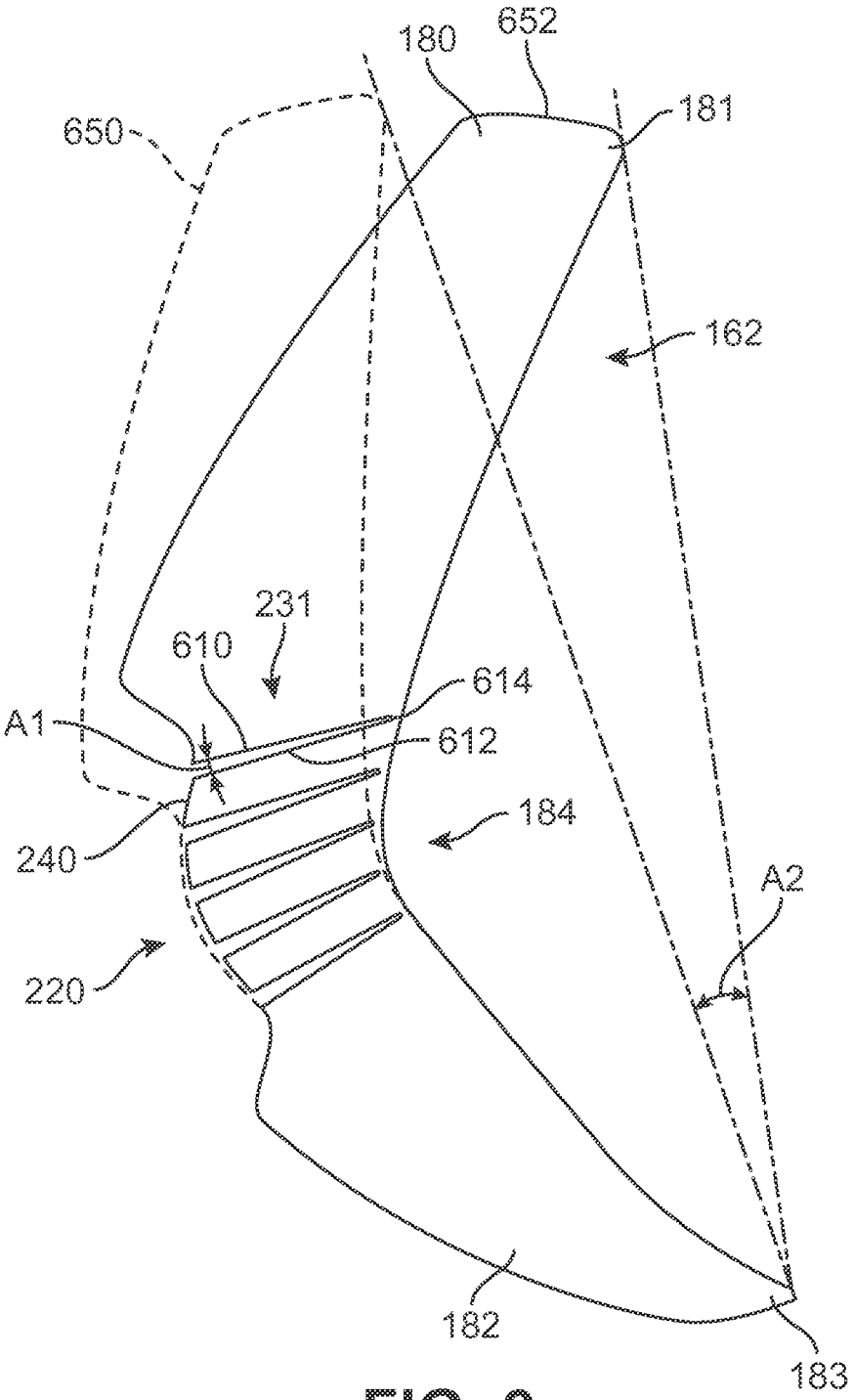
FIG. 6 is a schematic side view of an embodiment of a base member of a tongue, in which the base member is flexing.

The manner in which flex grooves impart increased flexibility to tongue 160 can be most clearly understood with reference to FIG. 6. FIG. 6 illustrates a side schematic view of an embodiment of base member 162 of tongue 160 undergoing flexing from a default position 650, which corresponds to an un-flexed position of base member 162, to a flexed position 652. In this view, base member 162 may be seen in isolation from covering member 164 and other components of tongue system 200. As seen in FIG. 6, the arrangement of plurality of flex grooves 220 in intermediate portion 184 allows intermediate portion 184 to flex in response to an applied force. For example, the type of flexing illustrated in FIG. 6 may correspond to typical flexing that would occur during use of article 100. In particular, lower portion 182 may be generally fixed in place with respect to outer shell 120 (for example, by permanently fastening lower portion 182 to an interior surface of outer shell 120). Therefore, forces applied at upper portion 180 by the foot and/or leg of a user may cause upper portion 180 to tilt forward as intermediate portion 184 flexes in response to the force.

Flexing of intermediate portion 184 may occur as plurality of flex grooves 220 open in response to an applied force at upper portion 180. As plurality of flex grooves 220 open, intermediate portion 184 may expand and thereby allow upper portion 180 to tilt forwards with respect to lower portion 182.

The geometry of an individual flex groove, which facilitates the expansion of intermediate portion 184, is also clearly illustrated in FIG. 6. For example, first flex groove 231 may include a first edge 610 and a second edge 612 that extend from lateral peripheral edge 240. Furthermore, first edge 610 and second edge 612 may be joined at vertex portion 614. As first flex groove 231 opens, first edge 610 and second edge 612 are separated. In some embodiments, this separation of first edge 610 and second edge 612 may be characterized by an opening angle A1 measured with respect to vertex portion 614. The opening angle A1 may vary between approximately 0 degrees, which corresponds to a closed position of first flex groove 231, and any angle substantially greater than 0 degrees, which corresponds to an open position of first flex groove 231. As the opening angle increases, the degree of flexibility imparted to intermediate portion 184 increases. It will be understood that the geometry of each of the remaining flex grooves may be substantially similar to first flex groove 231. Moreover, using multiple flex grooves in intermediate portion 184 may generally increase the overall flexibility of intermediate portion 184 as increasing numbers of flex grooves provide for a greater expansion length of intermediate portion 184.

Referring back to FIGS. 2 through 4, tongue system 200 may include provisions for controlling and/or limiting the flexibility of intermediate portion 184. In some embodiments, tongue system 200 may include a tensioning system 280 that may control the degree to which intermediate portion 184 (and therefore tongue 160) may undergo flexing. In other words, tensioning system 280 may be used to control the stiffness of tongue 160 by limiting the degree to which intermediate portion 184 may flex.

Tensioning system 280 may include various different components including, for example, a tensioning element and a tension control device. A tensioning element may be any element capable of applying tension to one or more portions of tongue 160. Examples of different tensioning elements include, but are not limited to, tensioning rods, tensioning cables, tensioning wires, as well as possibly other components known in the art for applying tension. In some embodiments, tensioning system 280 includes tensioning cable 282. Furthermore, the embodiments may utilize any of the various tensioning elements, components or devices disclosed in James et al., U.S. Patent Application Publication Number 2011/0214313, now U.S. patent application Ser. No. 12/717,902, filed Mar. 4, 2010 and titled "Flex Groove Sole Assembly with Biasing Structure," the entirety of which is incorporated by reference herein.

A tension control device may be any device used to control the tension of the tensioning element. Examples of different tension control devices include, but are not limited to: reel devices with a ratcheting mechanism, reel devices with a cam mechanism, manual tensioning devices, automatic tensioning devices, as well as possibly other kinds of tensioning devices. Examples of a tensioning device comprising a reel and ratcheting mechanism that could be used with the current embodiments are disclosed in Soderberg et al., U.S. Patent Application Publication Number 2010/0139057, now U.S. patent application No. 12/623,362, filed Nov. 20, 2009 and titled "Reel Based Lacing System", the entirety of which is hereby incorporated by reference. Embodiments including devices with a cam mechanism are described below and shown in FIGS. 13 through 15. In some embodiments, tensioning system 280 includes tension control device 284, which comprises a manually adjusted reel for winding tensioning cable 282 to increase or decrease tension (i.e., tighten or loosen).

Tension control device 284 may generally be mounted to a portion of tongue 160. In one embodiment, tension control device 284 may be mounted to upper portion 180 of tongue 160. In other embodiments, however, tension control device 284 may be mounted to lower portion 182 of tongue 160. In some embodiments, covering member 164 and base member 162 may be configured with mounting provisions. For example, covering member 164 may include a mounting portion 285 for receiving tension control device 284. In some cases, mounting portion 285 may include at least an opening for receiving a portion of tension control device 284. Additionally, in some cases, mounting portion 285 may include additional provisions such as a flange or raised rim configured to partially surround tension control device 284. Moreover, base portion 162 may include a mounting recess 289 that receives that back end of tension control device 284. Tension control device 284 may be retained in place within tongue 160 using any kinds of fasteners, adhesives and/or friction fits.

Tensioning cable 282 may be arranged along tongue 160 in a manner that best facilitates controlling the flexibility of intermediate portion 184. To achieve this control, in some embodiments, tensioning cable 282 may generally extend along a majority of the length of tongue 160, from upper portion 180 to lower portion 182. In one exemplary configuration, a first end portion 290 of tensioning cable 282 is attached to tension control device 284 in upper portion 180. A first intermediate portion 292 of tensioning cable 282 extends from upper portion 180 to lower portion 182. In particular, as most clearly seen in FIGS. 4 and 5, first intermediate portion 292 extends from tension control device 284 into a first interior channel 330 of tongue 160. First interior channel 330 includes an upper opening 332 at upper portion 180 along the outer side 168 of tongue 160 and a first lower opening 334 at lower portion 182 along the outer side 168 of tongue 160. In some embodiments, first interior channel 330 may be disposed between two or more layers of tongue 160. For example, in the current embodiment, first interior channel 330 may be disposed between layer 170 of base member 162 and covering member 164.

In some embodiments, upon exiting from first lower opening 334, tensioning cable 282 may wrap around a catching portion 340 of covering member 164. At this point, a second intermediate portion 294 of tensioning cable 282 (which may be generally continuous with first intermediate portion 292) may enter a second lower opening 336 and travel through a second interior channel (not shown) that is adjacent to first interior channel 330. The second interior channel may extend to tension control device 284. In particular, a second end portion 296 of tensioning cable 282 may pass through upper opening 332 and into tension control device 284.

Some embodiments utilize catching portion 340 to anchor tensioning cable 282 to lower portion 182. In some embodiments, catching portion 340 may be a flange-like portion or hook-like portion around which tensioning cable 282 may be wrapped. When engaged with catching portion 340, tensioning cable 282 may be used to apply tension to lower portion 182. Although the current embodiment comprises an open configuration that does not completely surround a segment of tensioning cable 282, in other embodiments, catching portion 340 may include portions having a closed configuration that encloses sections of tensioning cable 282, such as a ring-like or tube-like portion that projects outwardly from lower portion 182. It is also contemplated that in other embodiments, no catching portion may be used and instead cable 282 may be anchored at lower portion 182 directly by being threaded through first lower opening 334 and second lower opening 336.

Some embodiments can further include various tubes or guides for receiving tensioning cable 282 through various portions of tongue 160. Tubes and/or guides may be used to improve control of tensioning cable 282, for example, by reducing friction between tensioning cable 282 and adjacent parts of tongue 160. Likewise, tubes and/or guides may be used in some embodiments to constrain the motion of tensioning cable 282 in a particular direction.

The arrangement of tensioning cable 282 helps to control the flexibility of intermediate portion 184 and tongue 160. As the tension of tensioning cable 282 is increased (e.g., using tension control device 284), tensioning cable 282 limits the ability of upper portion 180 and lower portion 182 to bend or flex about intermediate portion 184. In particular, as the tension of tensioning cable 282 is increased, the amount that each flex groove can open is decreased, as the cable tension acts to keep adjacent segments of material from separating.

In some embodiments, the arrangement of tensioning cable 282 is selected to reduce flexing as cable 282 is tightened. In some embodiments, this may be accomplished by arranging tensioning cable 282 so that at least a portion of tensioning cable 282 is disposed proximally to the outer side 168 (i.e., inwardly of outer side 168) of tongue 160. Such an arrangement, in combination with the generally arcuate shape for tongue 160 described above, means that tightening tensioning cable 282 will tend to pull a first end portion 181 of tongue 160 and a second end portion 183 of tongue 160 further apart.

FIG. 4 illustrates an exemplary configuration for tensioning cable 282, in which tensioning cable 282 travels directly between tension control device 284 and catching portion 340. However, other embodiments may include any other arrangement for tensioning cable 282. For example, one possible alternative configuration is shown in FIG. 16.

Figure 16:
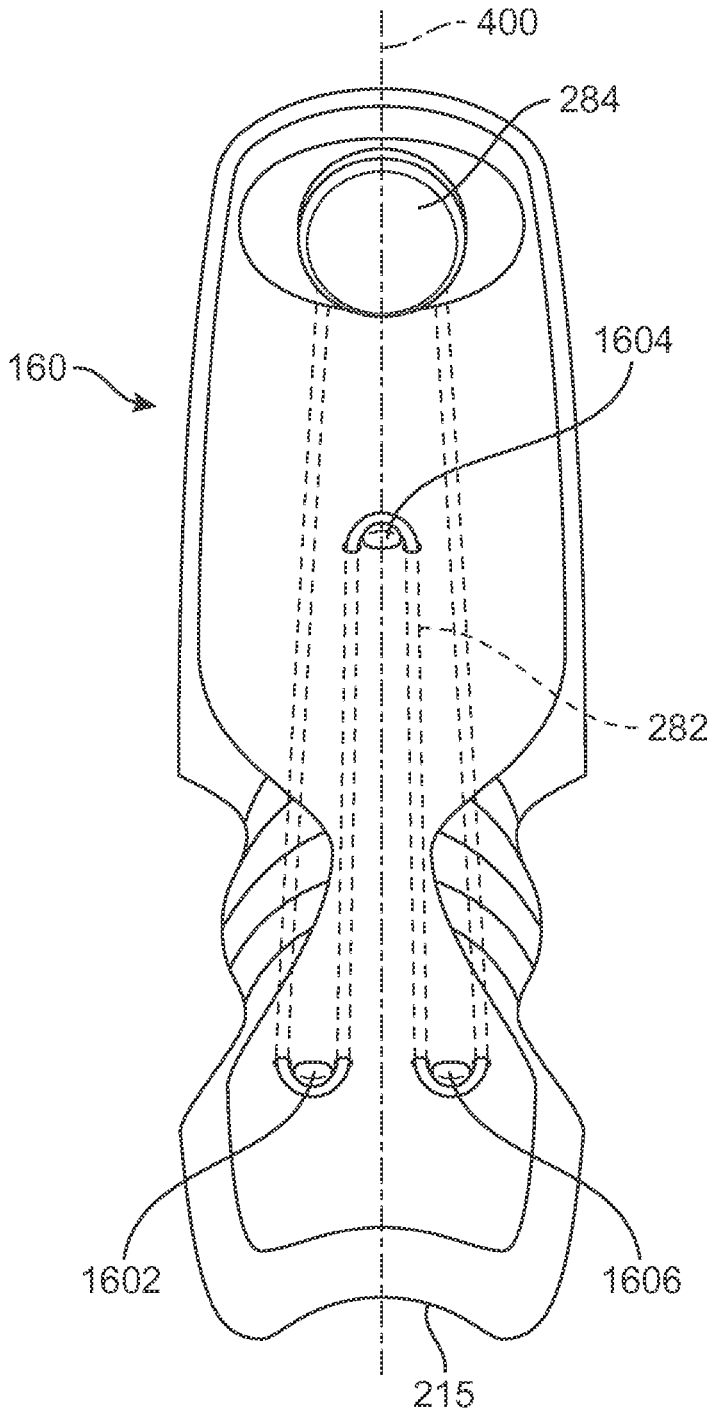
FIG. 16 is a schematic view of an embodiment of a tongue system including an alternate configuration for a tensioning cable.

Referring to FIG. 16, tensioning cable 282 may comprise additional turns over the previous embodiments. In particular, tensioning cable 282 may extend from tension control device 284 to first catching portion 1602 and then from first catching portion 1602 to second catching portion 1604. From second catching portion 1604 tensioning cable 282 may travel to third catching portion 1606 before returning to tension control device 284. Here, first catching portion 1602 and third catching portion 1606 may be disposed adjacent to lower peripheral edge 215, while second catching portion 1604 may be disposed closer to tension control device 284. This arrangement thus extends the length of tensioning cable 282 along tongue 160. Arranging two, three or more different catching portions to vary the path of tensioning cable 282 may thus provide variations in tensioning and tensioning control for tongue 160.

As previously discussed, FIG. 6 illustrates a schematic side view of an embodiment of base portion 162 flexing under some applied force. The degree of flexing can be characterized in different ways. One way to characterize the degree of flexing is to measure the angular displacement of the upper portion 180 with respect to some fixed point of lower portion 182. For example, in the exemplary embodiment shown in FIG. 6, first end portion 181 of tongue 160 undergoes an angular displacement A2 with respect to second end portion 183 of tongue 160, as tongue 160 flexes between a default position 650, which is an un-flexed position, and a flexed position 652.

Figure 7:
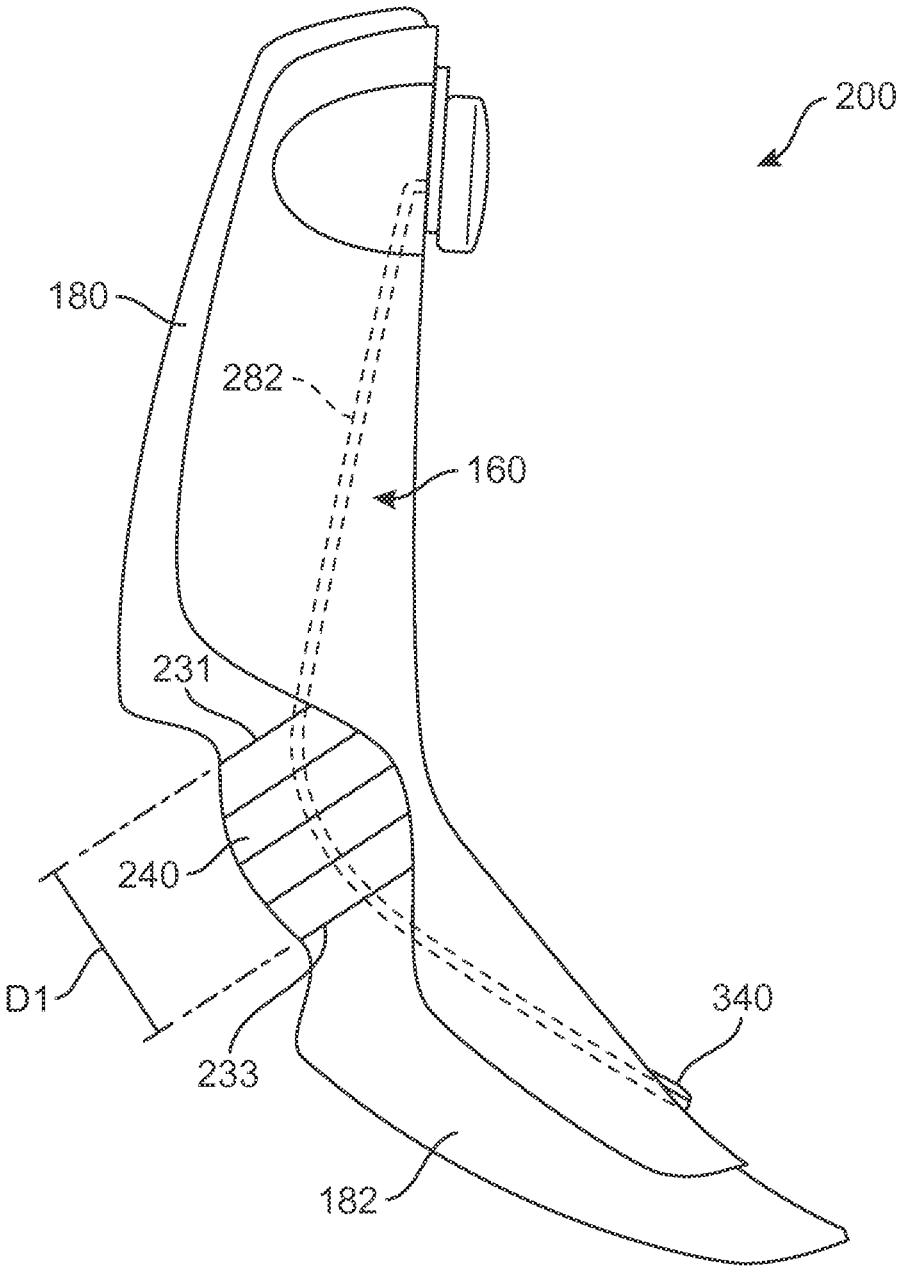
FIG. 7 is a schematic side view of an embodiment of a tongue system in a default position.
Figure 8:
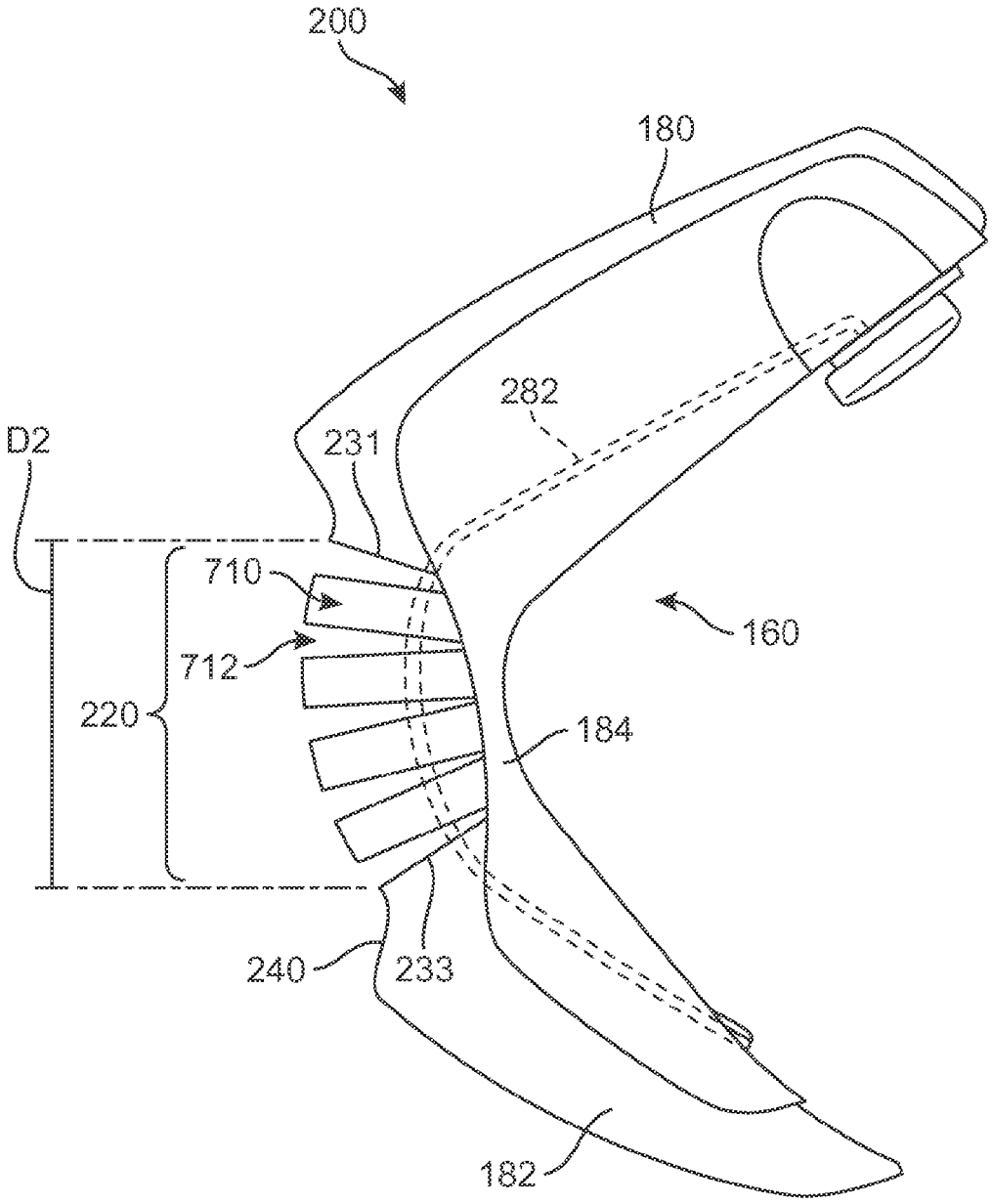
FIG. 8 is a schematic side view of the tongue system of FIG. 7 in a first maximally flexed position.

FIGS. 7 and 8 illustrate schematic side views of tongue system 200 in a default (un-flexed) position and a flexed position, respectively. In particular, FIG. 8 shows tongue 160 in a maximally flexed position. The term "maximally flexed position" is used throughout this detailed description and in the claims to refer to the furthest position from the default position to which tongue 160 is capable of flexing. It will be noted that in some embodiments, the maximally flexed position depends on the tension of the tensioning member, as described in further detail below. In the embodiment of FIG. 8, for example, the tension of tensioning cable 282 is set to allow tongue 160 to flex to any position between the default position and the maximally flexed position. However, tensioning cable 282 prevents tongue 160 from flexing beyond the maximally flexed position of FIG. 8.

For purposes of convenience, the term "flex profile" is used throughout this detailed description and in the claims to refer to the range of possible positions a tongue can take between the default position and the maximally flexed position. Thus, FIGS. 7 and 8 illustrate one possible flex profile that is associated with a predetermined amount of tension in tensioning cable 282. Further examples of different flex profiles, each associated with different amounts of tension for tensioning cable 282, are discussed in further detail below.

In some embodiments as tongue 160 flexes, the dimensions of intermediate portion 184 may vary. More specifically, while the dimensions of upper portion 180 and lower portion 182 may remain approximately constant throughout the flexing of tongue 160, the dimensions of intermediate portion 184 may vary as it expands during flexing. For example, in the default (un-flexed) configuration of FIG. 7, first flex groove 231 and third flex groove 233 are separated by a distance D1 at lateral peripheral edge 240. In the flexed configuration of FIG. 8, first flex groove 231 and third flex groove 233 are separated by a distance D2. In this embodiment, distance D2 is substantially greater than distance D1, as flex grooves 220 have opened up which increases the separation between first flex groove 231 and third flex groove 233.

Figure 9:
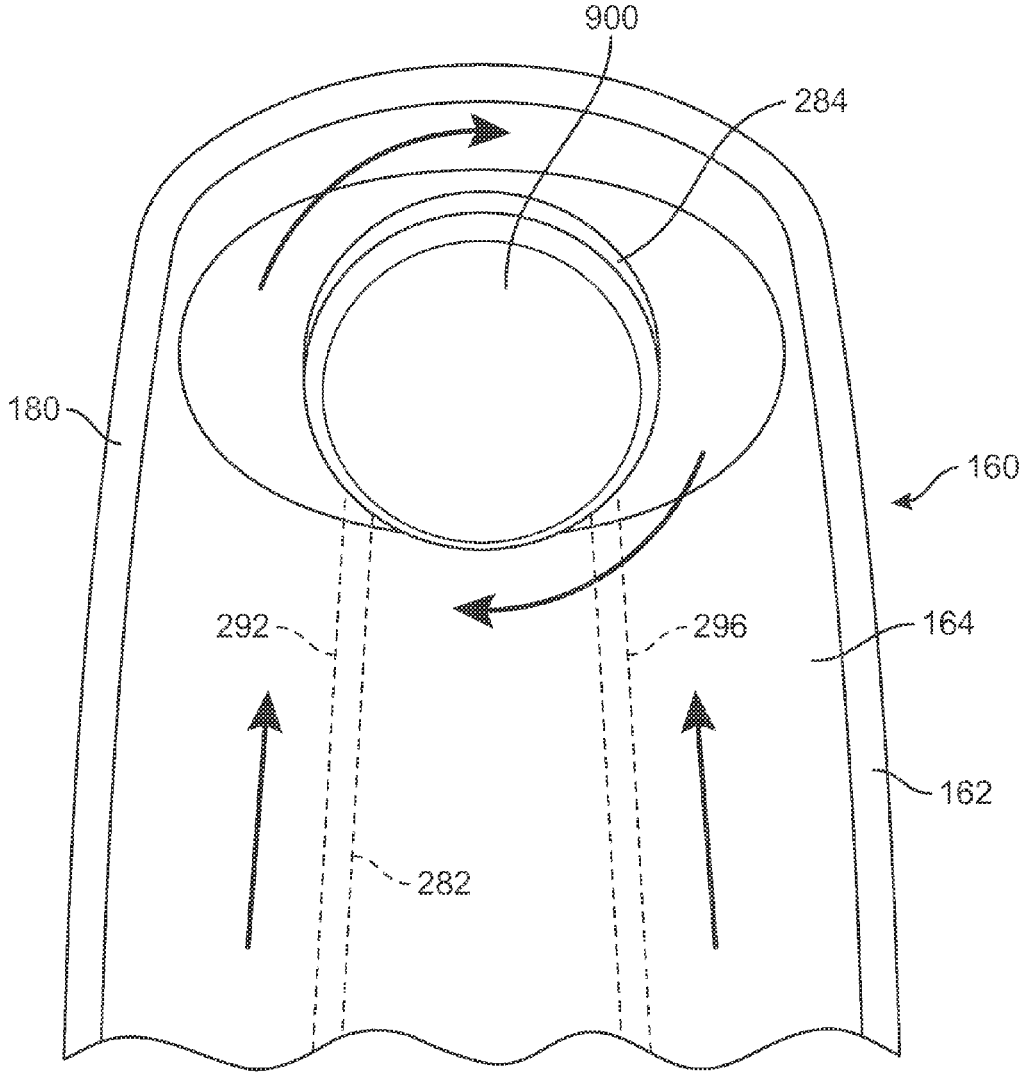
FIG. 9 is a schematic enlarged view of a portion of a tongue system showing a tensioning system being tightened.

In order to modify the tension of tensioning cable 282 (i.e., tightening cable 282), a user may turn a dial 900 on tension control device 284, as seen in FIG. 9. In particular, FIG. 9 illustrates an enlarged schematic view of an embodiment of upper portion 180 of tongue 160, including tension control device 284. As dial 900 is rotated, tensioning cable 282 may be wound onto a spool within tension control device 284. In some embodiments, as dial 900 rotates, both first end portion 292 and second end portion 296 of tensioning cable 282 may be wound onto a reel or spool of tension control device 284.

Figure 10:
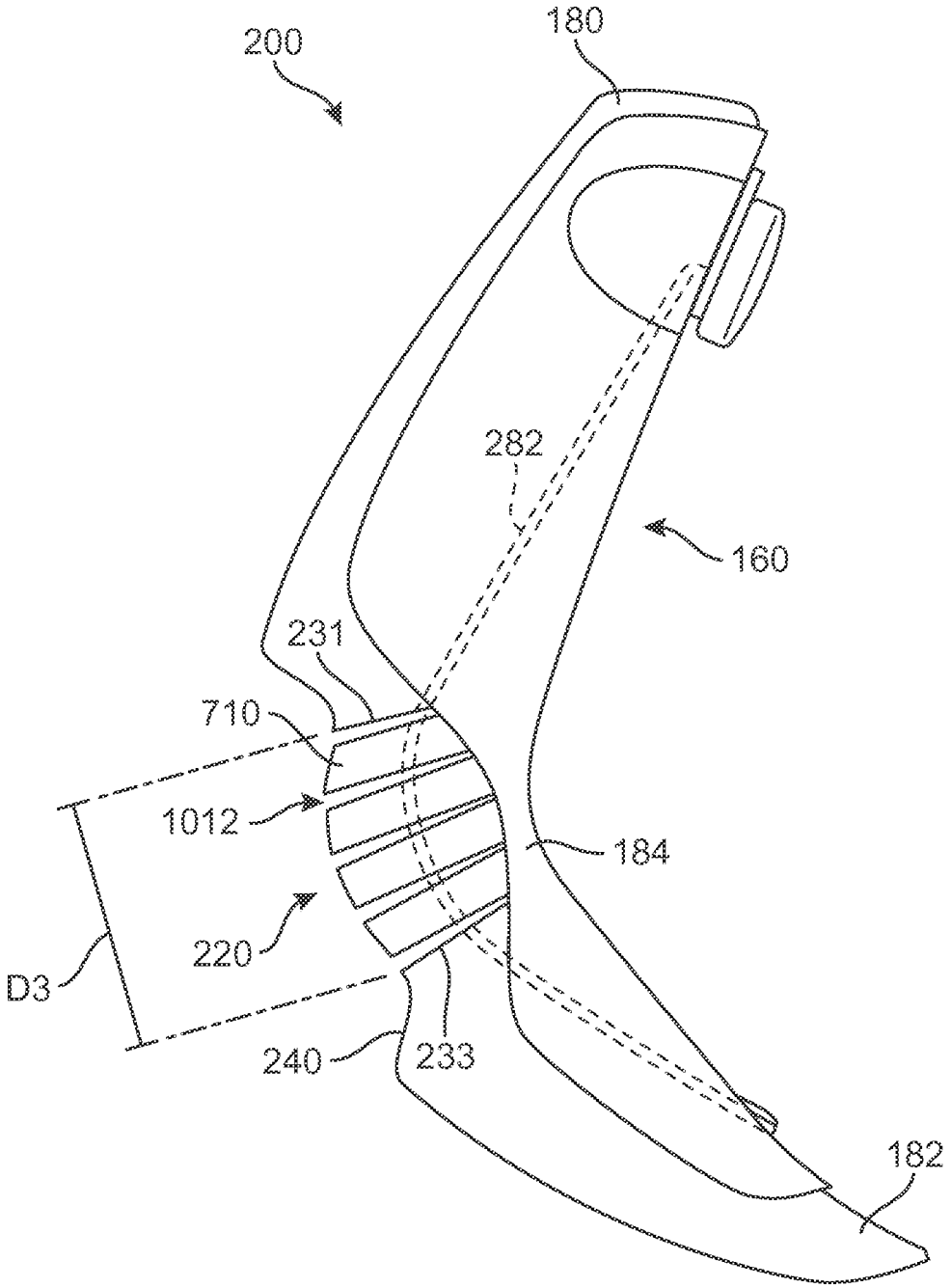
FIG. 10 is a schematic side view of the tongue system of FIG. 8 in a second maximally flexed position.

FIG. 10 illustrates a schematic side view of tongue system 200 in a configuration following the tightening of tensioning cable 282. In this configuration, tongue 160 is capable of flexing, but the degree of flexing has now been limited further over the configuration illustrated in FIG. 8. FIG. 10 shows a maximally flexed configuration for tongue 160 that achieves less overall flex for tongue 160 than the maximally flexed configuration of tongue 160 shown in FIG. 8. In other words, the flex profile of the configuration shown in FIG. 10 is different from the flex profile of the configuration shown in FIGS. 7 and 8. Thus, for example, first flex groove 231 and third flex groove 233 are separated by a distance D3 at lateral peripheral edge 240. In this embodiment, distance D3 is substantially less than distance D2 associated with the maximally flexed position shown in FIG. 8. Likewise, the spacing 1012 of plurality of flex grooves 220 is substantially smaller in the maximally flexed position shown in FIG. 10 than the spacing 712 of plurality of flex grooves 220 in the maximally flexed position of FIG. 8.

Figure 11:
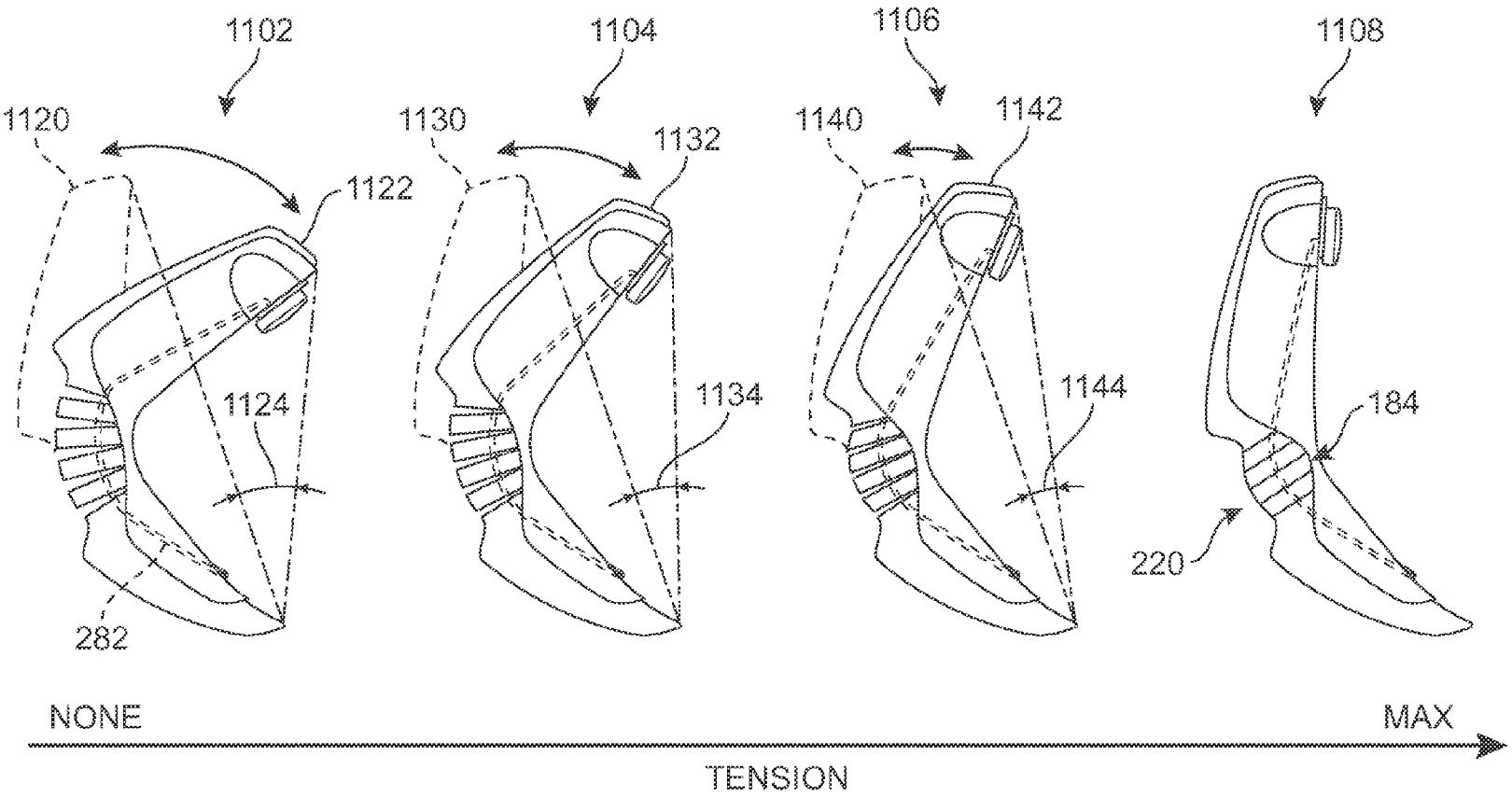
FIG. 11 is a schematic view of various different flex profiles for a tongue system according to an embodiment.

FIG. 11 shows a schematic view of an embodiment four different flex profiles for tongue 160, including a first flex profile 1102, a second flex profile 1104, a third flex profile 1106 and a fourth flex profile 1108. As indicated in FIG. 11, as the tension of tensioning cable 282 is increased, the ability of tongue 160 to flex decreases. In particular, each tension setting for tension system 280 corresponds to a range of possible flexing positions, including a maximally flexed position. For example, first flex profile 1102 is associated with a configuration for tongue 160 where little to no tension is applied by tensioning cable 282. In this configuration, tongue 160 can flex to any position between the default position 1120 and the maximally flexed position 1122. Moreover, the maximally flexed position 1122 corresponds to a maximum flexing angle 1124. As another example, second flex profile 1104 is associated with a configuration for tongue 160 where some tension is applied by tensioning cable 282 to tongue 160. In this configuration, tongue 160 can flex to any position between the default position 1130 and the maximally flexed position 1132. Moreover, the maximally flexed position 1132 corresponds to a maximum flexing angle 1134. As another example, third flex profile 1106 is associated with a configuration for tongue 160 where a greater amount of tension has been applied to tensioning cable 282 than in the configuration associated with second flex profile 1104. In this configuration, tongue 160 can flex to any position between the default position 1140 and the maximally flexed position 1142. Moreover, the maximally flexed position 1142 corresponds to a maximum flexing angle 1144. As still another example, fourth flex profile 1108 is associated with a configuration for tongue 160 where a maximum amount of tension has been applied by tensioning cable 282. In this configuration, tongue 160 is substantially stiffer than the previous configurations and in particular may not substantially flex at all under applied forces. This configuration may correspond to a flexing angle of approximately 0 degrees. Furthermore, unlike the previous configurations where the plurality of flex grooves 220 may substantially open, fourth flex profile 1108 corresponds to a configuration where plurality of flex grooves 220 are prevented from substantially opening due to the tension provided across intermediate portion 184 by tensioning cable 282.

As the tension of tensioning cable 282 is increased, the flexing angle associated with the maximally flexed position for tongue 160 is decreased. Thus, for example, maximum flexing angle 1124 is greater than maximum flexing angle 1134. Likewise, flexing angle maximum 1134 is greater than maximum flexing angle 1144. Moreover, as the degree to which tongue 160 can flex decreases with increased tension, the approximate stiffness of tongue 160 increases accordingly.

For purposes of clarity, only four particular flex profiles are shown in FIG. 11. However, it will be understood that some embodiments could utilize a continuous or near continuous range of possible flex profiles as the tension in tensioning cable 282 is changed over a continuous or near continuous range of values.

The embodiments shown in the Figures generally depict flexing in a particular direction, namely flexing so that the upper portion of the tongue flexes forwards towards the lower portion or toe region of the corresponding article. This type of flexing naturally accommodates motions common in snowboarding, allowing a user to lean forwards and/or backwards while applying some leverage to the snowboard according to the stiffness of the tongue. However, it will be understood that a tongue can be configured to flex in a variety of different directions and in some cases may be further capable of twisting about one or more axes of the tongue. The degree of flexing achieved in different directions may depend on the number, size, shape and/or orientation of flex grooves. For example, flex grooves of the embodiments shown in FIGS. 1 through 11 may allow for some flexing or twisting about the longitudinal axis of tongue 160.

An intermediate portion may facilitate flexibility using any means including means other than flex grooves. For example, some other embodiments may utilize an intermediate portion made of a material that may flex, especially in a particular direction.

Figure 12:
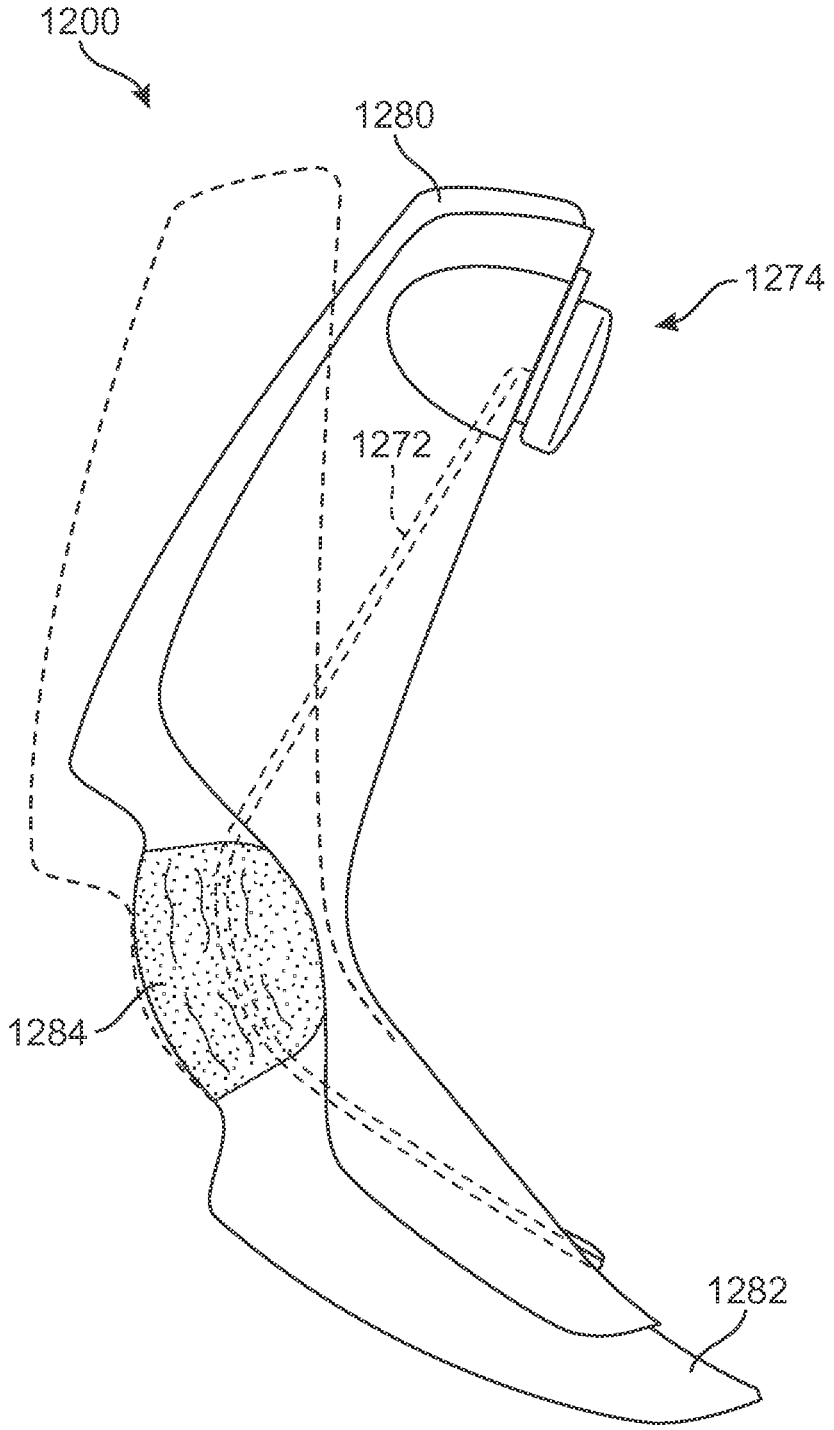
FIG. 12 is a schematic side view of another embodiment of a tongue system.

FIG. 12 illustrates a schematic side view of another embodiment of a tongue 1200. Referring to FIG. 12, tongue 1200 may include some similar provisions to the embodiments discussed above. In particular, tongue 1200 may include an upper portion 1280, a lower portion 1282 and an intermediate portion 1284. In some embodiments, upper portion 1280 and lower portion 1282 may be made of a first material, while intermediate portion 1284 may be made of a second material that is substantially different than the first material. In some embodiments, the second material is substantially more flexible and/or elastic than the first material. Thus, as forces are applied to tongue 1200, tongue 1200 may tend to flex at intermediate portion 1284. This allows tongue 1200 to achieve different flexing positions in a similar manner to the flexing positions achieved by tongue 160 of the previous embodiments through the use of flex grooves. Moreover, tensioning cable 1272 and tension control device 1274 may be used control the tension applied across tongue 1200 in order to limit the flexibility of tongue 1200 and thereby control stiffness.

In some embodiments, to prevent tongue 1200 from flexing in a rearwardly direction, a material may be chosen so that intermediate portion 1284 expands when upper portion 1280 is pushed in the forwards direction, but resists compression when upper portion 1280 is pulled backwards.

Examples of different materials that could be used for intermediate portion include, but are not limited to: elastomers, fabrics with elastic properties as well as any other kinds of materials. The particular material for a particular embodiment may be selected according to factors including manufacturing costs, desired elasticity, desired compressibility, durability as well as possibly other factors.

Figure 13:
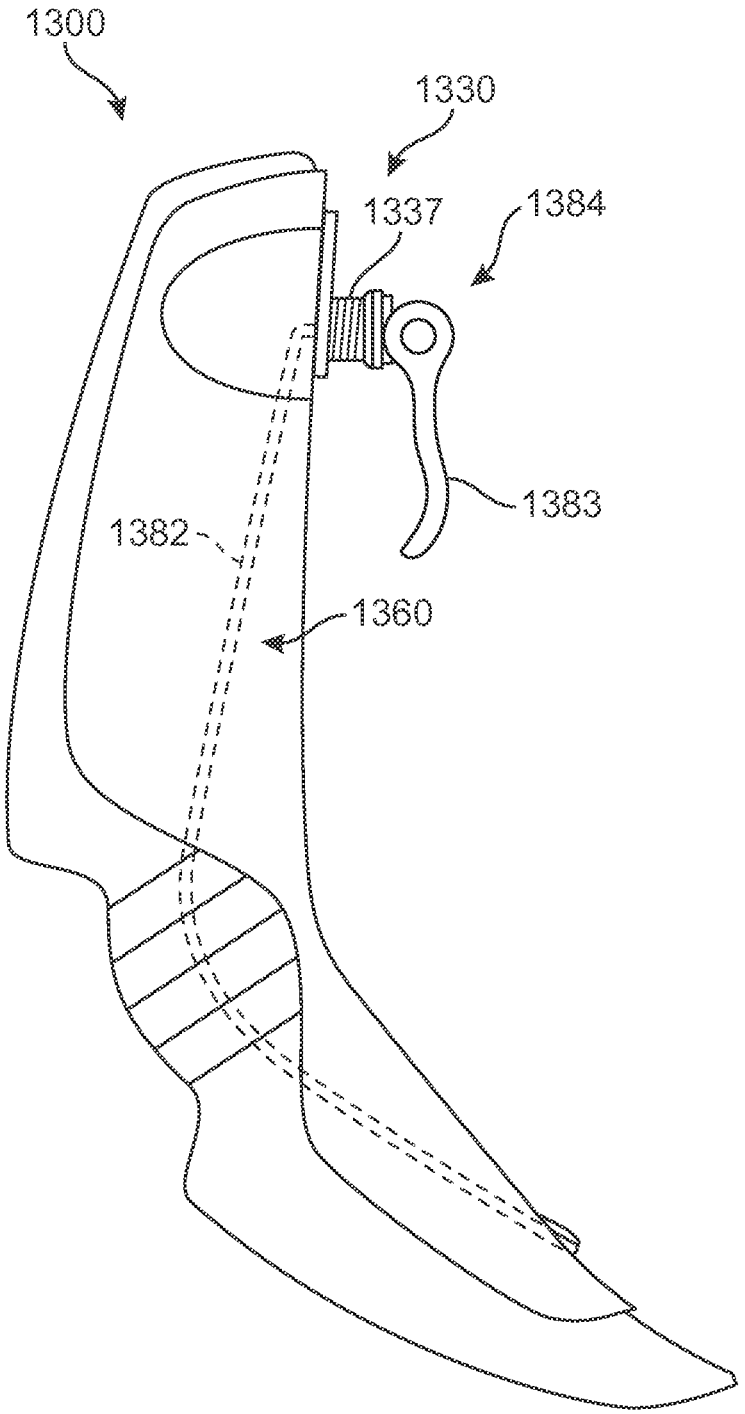
FIG. 13 is a side schematic view of an embodiment of a tongue system including a tension control device using a cam mechanism.
Figure 14:
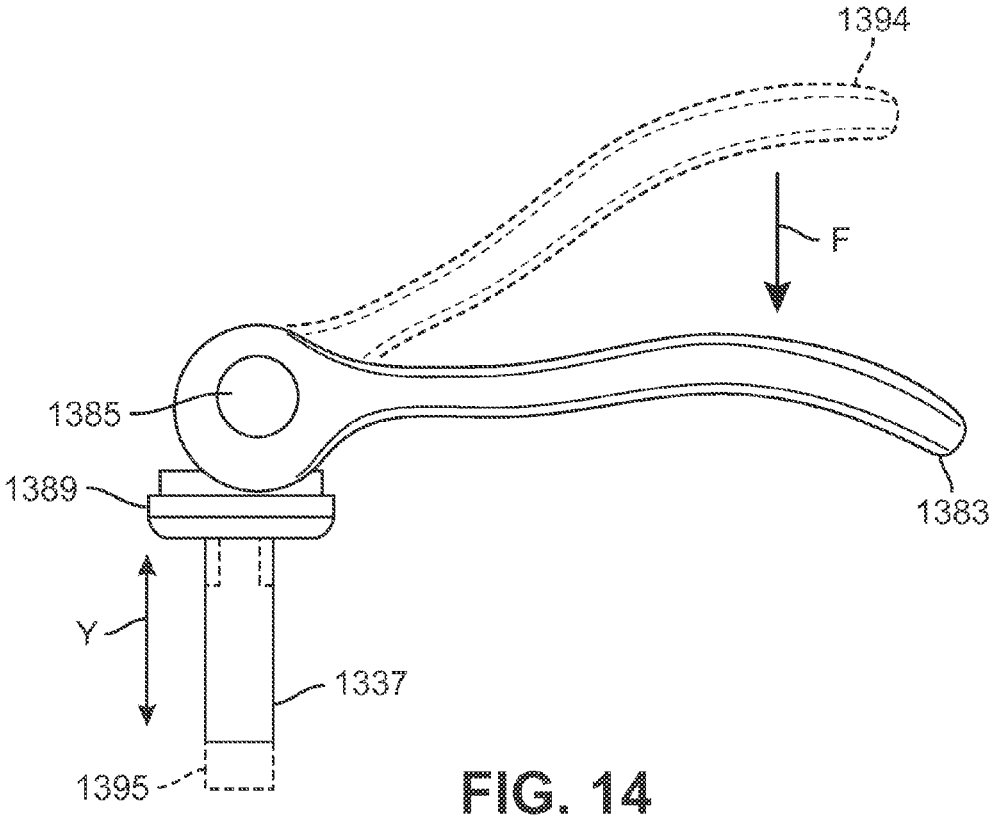
FIG. 14 is a side schematic view of an embodiment of the tension control device of FIG. 13.
Figure 15:
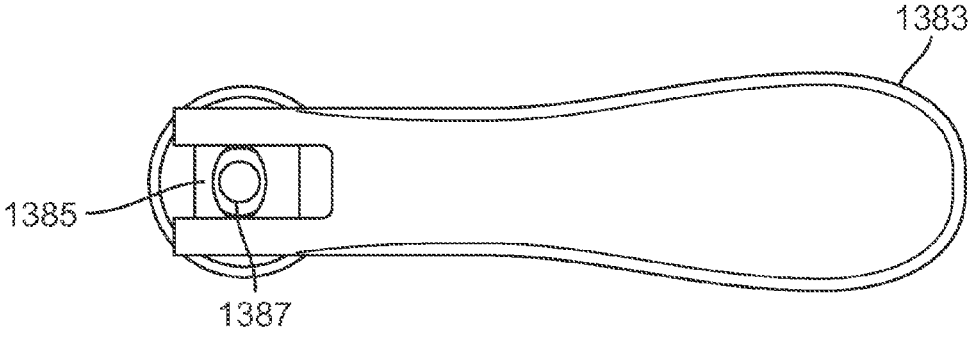
FIG. 15 is a top down schematic view of an embodiment of the tension control device of FIG. 13.

FIGS. 13 through 15 illustrate views of an alternative embodiment of a tongue system that uses a cam-type mechanism to adjust the tension of a tensioning cable. In particular, FIG. 13 is a side schematic view of tongue system 1300 including tongue 1360 and tensioning system 1330. FIGS. 14 and 15 illustrate portions of a tension control device of tensioning system 1330.

Referring to FIGS. 13 through 15, tensioning system 1330 includes tensioning cable 1382 and tension control device 1384. In this embodiment, tension control device 1384 comprises a spindle 1337, a handle 1383, a pin 1387 and a stopper 1389. Spindle 1337 may be attached to pin 1387, which may be further connected to handle 1383. Handle 1383 may be further mounted on an axle 1385. In some embodiments pin 1387 may be connected to handle 1383 in such a manner that rotation about axle 1385 causes pin 1387 to move axially along the labeled Y axis. In other embodiments, different arrangements may also be used.

In some embodiments handle 1383 may be able to move from an open position to a closed position. When handle 1383 is in the open position (shown as dotted position 1394) handle 1383 may be rotated along an axis defined by spindle 1337. In some embodiments this rotation may wind end portions of tensioning cable 1382 around spindle 1337. Once the user has tightened tensioning cable 1382 as desired, handle 1383 may be pressed into a closed position, in the direction of arrow F. The rotation caused by this movement along axle 1385 may cause the entire spindle 1337 to be moved from an initial position (shown as dotted position 1395) towards handle 1383 along the Y axis.

In some embodiments, the axial movement presses spindle 1337 against a stopper 1389. The friction of spindle 1337 against stopper 1389 may prevent further spindle rotation, and the axial movement may also further tighten tensioning cable 1382 for a final snug fit.

In an alternate embodiment, spindle 1337 may be optional. In such an embodiment, tensioning cable 1382 may be directly attached to pin 1387. The rotation of handle 1383 about axle 1385 may cause pin 1387 to pull cable 1382 taut. Still other embodiments using a mechanical locking mechanism by themselves, or in combination with the spindle 1337, are envisioned.

In addition to the provisions described above and shown in the figures, embodiments may include any of the features, systems, components or methods for tightening portions of an article as disclosed in Smaldone et al., U.S. Patent Application Publication Number US2014/0157627, published Jun. 12, 2014 (U.S. patent application Ser. No. 13/939,210, filed Jul. 11, 2013), and titled "Article of Footwear with Adjustable Stiffness," the entirety of which is herein incorporated by reference.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An adjustable tongue system for an article of footwear, comprising:

a tongue including at least one flex groove, wherein the at least one flex groove opens to allow the tongue to flex;

wherein the tongue extends in a longitudinal direction from a lower portion to an upper portion;

wherein the at least one flex groove of the tongue is disposed between the upper portion and the lower portion;

wherein, when viewed from a side cross-sectional view, the tongue has a generally arcuate shape along the longitudinal direction, with a generally concave outer side and a generally convex inner side, and as the at least one flex groove flexes, the upper portion of the tongue angularly displaces with respect to the lower portion of the tongue;

a tensioning system attached to the upper portion and the lower portion of the tongue;

wherein the tensioning system applies a tension from the upper portion to the lower portion generally along the longitudinal direction;

wherein the tension of the tensioning system limits both the amount that the at least one flex groove opens and the angular displacement between the upper portion and the lower portion;

wherein the at least one flex groove is disposed on at least one of a medial side and a lateral side of the tongue and includes a first edge and a second edge that is joined to the first edge at a vertex portion of the at least one flex groove, and wherein the at least one flex groove is further associated with an opening angle between the first edge and the second edge; and wherein the opening angle has a value of approximately 0 degrees when the at least one flex groove is closed and wherein the opening angle has a value substantially greater than 0 degrees when the at least one flex groove is open.

2. The adjustable tongue system according to claim 1, wherein as the tension applied by the tensioning system increases, the value substantially greater than 0 degrees of the opening angle decreases.

3. The adjustable tongue system according to claim 1, wherein the tension applied by the tensioning system ranges from a minimum tension applied when the at least one flex groove is closed to a maximum tension applied with the at least one flex groove is open.

4. The adjustable tongue system according to claim 1, wherein a flexed position of the tongue relative to an un-flexed position of the tongue is characterized by a flexing angle and wherein the range of possible flexing angles is controlled using the tensioning system.

5. The adjustable tongue system according to claim 1, wherein the overall stiffness of the tongue increases as the tension of the tensioning system is increased.

6. The adjustable tongue system according to claim 1, wherein the at least one flex groove is prevented from substantially opening when the adjustable tongue system is in a fully tightened state.

7. The adjustable tongue system according to claim 1, wherein the tensioning system comprises a tensioning cable and a tensioning device that adjusts the tensioning cable and wherein the tensioning cable extends generally in the longitudinal direction between the upper portion and the lower portion of the tongue and stays within a perimeter of the tongue.

8. An adjustable tongue system for an article of footwear, comprising:

a tongue having an inner side and an outer side, and extending in a longitudinal direction from an upper portion to a lower portion;

wherein the tongue has a flexible portion disposed between the upper portion and the lower portion;

wherein the flexible portion defines at least one flex groove extending from a vertex portion at an interior of the flexible portion to an opening portion at a peripheral edge of the flexible portion;

a tensioning cable attached to the upper portion of the tongue and the lower portion of the tongue, and applying tension between the upper portion of the tongue and the lower portion of the tongue;

a tensioning device that adjusts the tension of the tensioning cable;

wherein a portion of the tensioning cable is disposed proximal to the outer side in at least one of the upper portion and the lower portion of the tongue;

wherein, when viewed from a side cross-sectional view, as the tension increases, an angle on the outer side between the upper portion and the lower portion increases and an opening angle of the at least one flex groove as measured with respect to the vertex portion decreases from a first value substantially greater than 0 degrees to a second value of approximately 0 degrees; and wherein adjusting the tensioning cable controls the degree of flexing of the flexible portion and the flexibility of the tongue.

9. The adjustable tongue system according to claim 8, wherein the tensioning device is a reel with a ratcheting mechanism.

10. The adjustable tongue system according to claim 8, wherein the tensioning device is a reel with a cam mechanism.

11. The adjustable tongue system according to claim 8, wherein, when viewed from the side cross-sectional view, the tongue has a generally arcuate shape along the longitudinal direction, with a generally concave outer side and a generally convex inner side, and wherein the tensioning cable extends inwardly of the outer side.

12. The adjustable tongue system according to claim 8, wherein the opening portion of the at least one flex groove is disposed at a medial side or a lateral side of the flexible portion of the tongue.

13. The adjustable tongue system according to claim 8, wherein the tensioning cable applies a maximum tension when the opening angle is at the first value.

14. The adjustable tongue system according to claim 8, wherein the flexible portion includes sets of grooves, each set including a first groove on a lateral side of the tongue and a corresponding second groove on a medial side of the tongue.

15. An adjustable tongue system for an article of footwear, comprising:

a tongue and a tensioning system for controlling the flexibility of the tongue;

the tongue including a lower portion, an upper portion, and an intermediate portion that is disposed between the lower portion and the upper portion and that has at least one flex groove;

wherein the at least one flex groove extends from a vertex portion at an interior of the intermediate portion to an opening portion at a peripheral edge of the intermediate portion;

the tongue being associated with a default position at which the tongue is un-flexed and an opening angle of the at least one flex groove as measured with respect to the vertex portion is a first value of approximately 0 degrees;

the tongue flexing to any position approximately between the default position and a first maximally flexed position at which the opening angle of the at least one flex groove as measured with respect to the vertex portion is a second value substantially greater than 0 degrees, when the tensioning system applies a first tension to the tongue generally in a longitudinal direction of the tongue from a lower attachment point at the lower portion of the tongue to an upper attachment point at the upper portion of the tongue, which limits angular displacement between the lower portion and the upper portion to a first angular displacement;

the tongue flexing to any position approximately between the default position and a second maximally flexed position at which the opening angle of the at least one flex groove as measured with respect to the vertex portion is a third value substantially greater than 0 degrees, when the tensioning system applies a second tension to the tongue generally in the longitudinal direction of the tongue from the lower attachment point at the lower portion of the tongue to the upper attachment point at the upper portion of the tongue, which limits angular displacement between the lower portion and the upper portion to a second angular displacement less than the first angular displacement;

wherein the first maximally flexed position is substantially further from the default position than the second maximally flexed position;

wherein the second value is greater than the third value; and wherein the first tension is substantially less than the second tension.

16. The adjustable tongue system according to claim 15, wherein the first maximally flexed position is associated with a first maximum flexing angle and wherein the second maximally flexed position is associated with a second maximum flexing angle and wherein the first maximum flexing angle is substantially greater than the second maximum flexing angle.

17. The adjustable tongue system according to claim 15, wherein the intermediate portion expands in size between the default position and the first maximally flexed position and between the second maximally flexed position and the first maximally flexed position.

18. The adjustable tongue system according to claim 15, wherein the lower attachment point comprises a catching portion around which a tensioning cable of the tensioning system wraps.

19. The adjustable tongue system according to claim 15, wherein the opening portion of the at least one flex groove is disposed at a medial side or a lateral side of the intermediate portion of the tongue.

20. The adjustable tongue system according to claim 19, wherein the at least one flex groove comprises sets of grooves, each set including a first groove on a lateral side of the tongue and a corresponding second groove on a medial side of the tongue, and wherein an inward end of the first groove is spaced apart from an inward end of the second groove.

* * * * *